United States Patent [19]

Litchfield

[11] Patent Number: 4,874,169

[45] Date of Patent: Oct. 17, 1989

[54] BALL

[76] Inventor: Peter G. Litchfield, 6 Ella Grove, Chelsea, Victoria, Australia, 3196

[21] Appl. No.: 171,464

[22] Filed: Mar. 21, 1988

Related U.S. Application Data

[63] Continuation of Ser. No. 834,964, Feb. 28, 1986, abandoned, which is a continuation-in-part of Ser. No. 676,941, Nov. 30, 1984, abandoned.

[30] Foreign Application Priority Data

Dec. 2, 1983 [AU] Australia ..... PG2670

[51] Int. Cl.[4] ..... A63B 39/08

[52] U.S. Cl. ..... 273/60 R; 273/58 X; 273/26 R; 273/61 R

[58] Field of Search ..... 273/58 K, 58 B, 232, 273/58 BA, 58 A, 58 R, 58 J, 60 R, 60 A, 65 EF, 26 R, 26 D, 61 R; 40/327

[56] References Cited

U.S. PATENT DOCUMENTS

| | | | |
|---|---|---|---|
| D. 61,805 | 1/1923 | Griffiths | 273/58 B |
| 2,324,277 | 7/1943 | Casey et al. | 273/58 K X |
| 4,616,828 | 10/1986 | Haythornthwaite | 273/58 K |

*Primary Examiner*—George J. Marlo

*Attorney, Agent, or Firm*—Dennison, Meserole, Pollack & Scheiner

[57] ABSTRACT

A game ball has a first hemisphere provided with depressions or protrusions which constitute from 1% to 30% of the surface of the hemisphere, the depressions being located solely in the middle one-third annulus of the hemisphere. When projected along the plane of a line joining the first hemisphere and a second hemisphere, the ball will deviate from a normal trajectory in the direction of the one hemisphere. The second hemisphere may have a smooth surface, or may have a uniform texture, such as that found on a tennis ball.

9 Claims, 6 Drawing Sheets

BALL

This is a continuation of application Ser. No. 834,964, Peter G. Litchfield, filed Feb. 28, 1986, which is a continuation-in-part of application Ser. No. 676,941, filed Nov. 30, 1984, both applications now abandoned.

BACKGROUND OF THE INVENTION

1. Field of the Invention

This invention relates to a ball which may be used for playing ball games, such as baseball, or may be used as a practice ball for such games.

2. Description of the Prior Art

In baseball, a pitcher will, in order to deceive a batter throw a baseball so that it describes curves which differ from the normal or expected trajectory from the mound to the plate. Only pitchers with the appropriate level of skill can produce effective pitches of this general type, variants of which are termed 'curve', 'slider', 'sinker' and 'break'.

It is known that such trajectories can be obtained or exaggerated by tampering with the ball. This is discussed in an article entitled 'Masters of Mischief' which appears on pages 92 and 93 of the October issue of 'Science '83'. The theory behind the behaviour of baseballs when pitched to curve to the plate is not well understood, although it appears that atmospheric conditions can affect the degree of curve.

In U.S. Pat. Nos. 4,128,238 and 4,286,783, both to Newcomb and Newcomb, Jr., there are described practice baseballs which have portions of the surface removed to allow the ball to curve when it is pitched as a straight ball. As the ball is not generally spherical, it cannot properly be used for playing baseball, but may only be used as a practice ball.

The behaviour of the ball in the game of cricket can be similar to the described movement of a baseball. In cricket, the ball can be made to 'move' or 'swing' by a skilled bowler, the movement being to the left or to the right of a line from the bowler to the batsman. Of course, in cricket the intention is for the ball to strike the ground before it reaches the batsman, and accordingly the swing or movement takes place before the ball strikes the ground.

In cricket, the movement is believed to be accentuated by polishing one hemisphere of the ball, to one side of the circumferential seam, whilst leaving the other hemisphere unpolished, but again the theory behind the behaviour of the ball is not well understood. United Kingdom Patent application No. 2091110A to Phillips describes a simulated cricket ball which assists an inexperienced bowler in obtaining 'swing'. This is achieved by providing a simulated seam which is higher than that of a conventional ball.

In the design of golf ball surface textures, the only consideration is to produce a ball which will *not* deviate from an expected trajectory. Thus, the conventional golf ball has a regular pattern of dimples in its spherical surface, the total area of the dimples usually constituting between 55% and 61% of the total surface area of a golf ball.

On page 15 of 'Capital City Federal Home Owner', July-August 1972, published by Capital City Federal Savings & Loan Association of Washington, D.C., there is a brief discussion of the need for such a regular pattern of dimples in an article entitled 'Why a golf ball has dimples'.

The article describes empirical flight tests of conventionally dimpled golf balls, golf balls with completely smooth surfaces, and golf balls with one smooth half and one fully dimpled half. Although the article states that the 'half-smooth' balls travelled much less further than conventional balls, and that they executed 'violent right curve' slices when projected with the dimpled half on the right, and a hook to the left with the dimpled half on the left, no details of the degree of deviation are provided. Furthermore, the aerodynamic behavior of gold balls struck with a high degree of velocity and backspin may not relate to the likely behavior of a much larger hand projected play ball having low velocity and degree of backspin.

None of the prior art balls provides a ball which can be played with as a normal ball, but which can be projected to deviate from a normal or expected path, in games, or to give practice to a hitter or batsman.

BRIEF SUMMARY OF THE INVENTION

The invention is directed towards a generally spherical ball for projection to deviate from a normal or expected trajectory, the generally spherical surface of said ball being constituted by a first generally hemispherical surface and a second generally hemispherical surface, said first generally hemispherical surface being provided with a disturbed area or surface disturbance, the total area of which occupies between 1% and 30% of the area of said first generally hemispherical surface.

In this specification and the amended claims, 'disturbed area' or surface disturbance means an area of an otherwise generally smooth generally hemispherical surface, the smooth surface being disturbed by the area in that the area is a depression in the surface, or a protrusion rising from the surface.

Preferably, said disturbed area or plurality of disturbed areas is located in the middle third of said first generally hemispherical surface between the circular boundary between said hemispherical surfaces and the apex of said first generally hemispherical surface.

Alternatively, said disturbed area or plurality of disturbed areas is constituted by a protrusion or protrusions on said first generally hemispherical area.

It is an object of this invention to provide a ball which can be used for normal play, but which is also capable, when pitched or bowled, of deviation from a normal or expected trajectory.

DETAILED DESCRIPTION OF THE INVENTION

In this description, reference to a ball is intended to be a reference to a generally spherical ball, it being considered that the difficulties in projecting a nonspherical ball, and in the relationship of the more complex shape as it moves through the air, may render the application of this invention to such a ball ineffective.

Figure 1:
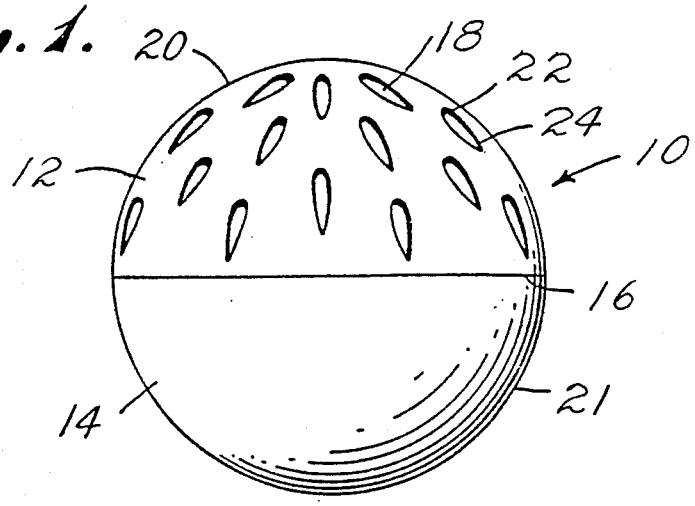
FIG. 1 is a side elevation of a ball in accordance with this invention.
Figure 2:
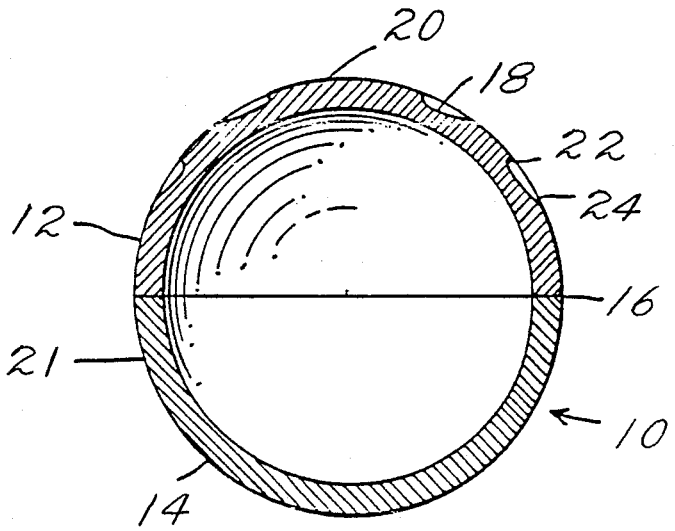
FIG. 2 is a cross-section through the ball of FIG. 1.

FIGS. 1 and 2 show a ball 10 which is hollow, and is preferably made from rubber or a similar material.

The generally spherical ball 10 comprises a first hemisphere 12 and a second hemisphere 14, the two hemispheres being joined by a line 16 which may be a visible seam caused by a moulding process, or may simply be an imaginary line.

First hemisphere 12 has a generally smooth hemispherical surface 20. The surface 20 has a number of depressions 18, each of which constitutes a 'disturbed area'. Each depression 18 has the shape of an elongated tear, and has a sharp edge 22 nearest the apex of hemisphere 12, and a more gentle, gradually sloping edge 24 at the other end of the depression. The depressions 18 are arranged in a regular pattern on hemispherical surface 20, and constitute 9.8% of the total area of hemisphere 12.

Second hemisphere 14 has a hemispherical surface 21 which is smooth and uninterrupted. Hemispherical surfaces 20 and 21 have the same diameter, as shown particularly in FIG. 2.

Figure 3:
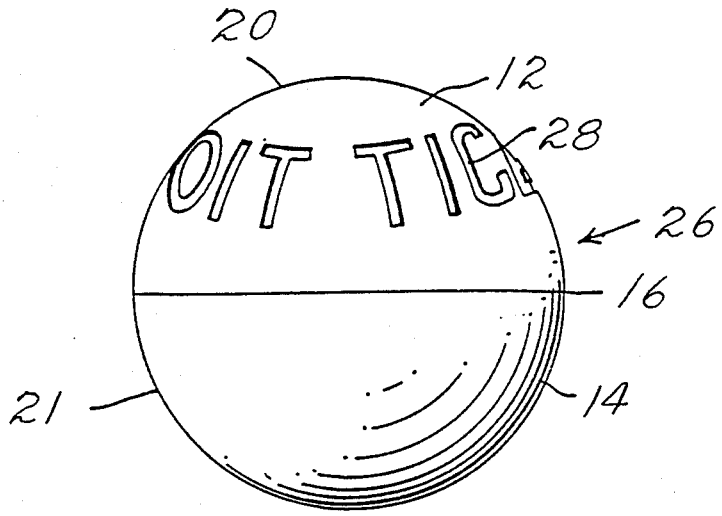
FIG. 3 is a side elevation of another ball in accordance with this invention.
Figure 4:
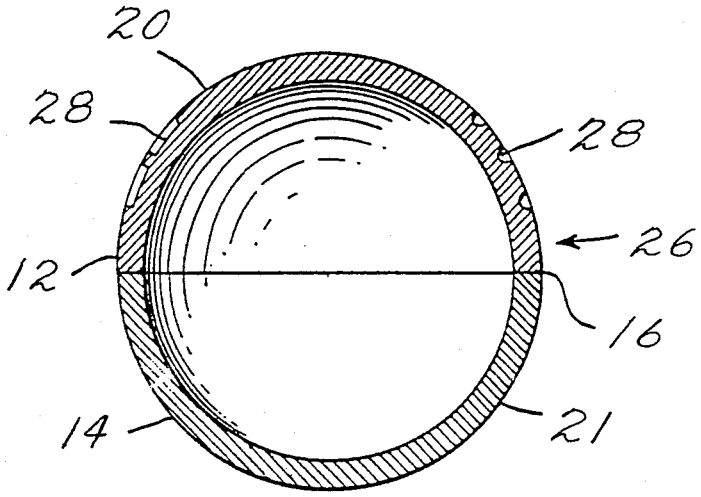
FIG. 4 is a cross-section through the ball of FIG. 3.

The ball 26 of FIGS. 3 and 4 is substantially the same as that of FIGS. 1 and 2, and reference numerals 12 to 16, 20 and 21, have the same meanings as in FIGS. 1 and 2.

In ball 26, depressions 28 are provided in the otherwise smooth surface 20 of first hemisphere 12, but in this embodiment each is in the nature of a letter forming words. The letters could form the name of a sporting club or organization or a trade mark. Alternatively the depressions 28 could be in the shape of a symbol such as a map of Australia, a logo, numerals or the like. In the embodiment of FIGS. 3 and 4, the depressions 28 constitute 7.6% fo the total area of hemisphere 12, and it can be seen that they occupy the middle one-third annulus of surface 20, mid-way between boundary 16 and the apex of the hemisphere.

In ball 26, second hemisphere 14 has a smooth and uninterrupted surface 21.

As illustrated in FIG. 4, the cross-sectional shape of depressions 28 may be generally rectangular (left-hand side) or generally rounded (right-hand side).

Figure 5:
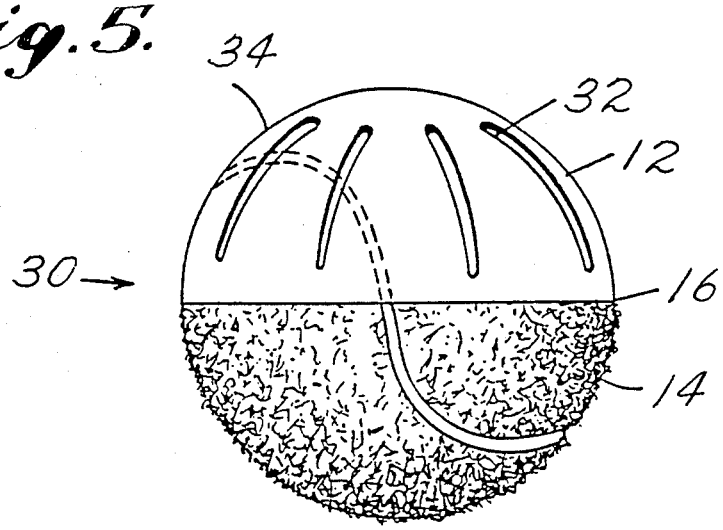
FIG. 5 is a side elevation of a tennis ball treated to form a further ball in accordance with this invention.
Figure 6:
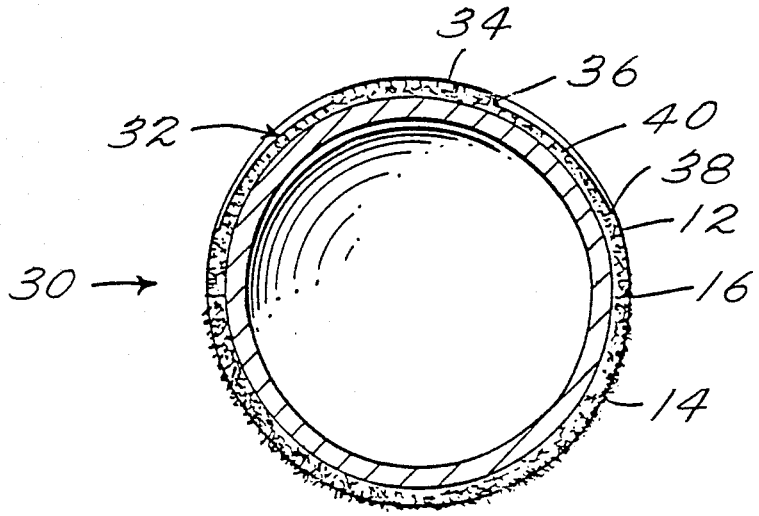
FIG. 6 is a cross-section through the ball of FIG. 5.

The ball 30 of FIGS. 5 and 6 is a modified tennis ball of conventional construction. First hemisphere 12 of the ball is coated with a plastics or any other suitable material to provide a generally hemispherical surface 34, whilst the second hemisphere 14 has the usual rough texture of tennis ball surfaces. In this embodiment boundary line 16 between hemispheres 12 and 14 is likely to be more visible.

Depressions 32 are provided in the surface 34 of hemisphere 12. The depressions 32 are similar to depressions 18 of ball 10 of FIGS. 1 and 2 in that each of them constitutes a 'disturbed area' of surface 34, except that they are extended, and there are fewer of them. Each depression 32 has a sharp edge 36 nearest the crown of hemisphere 12, and a shallower edge 38 at the other end thereof. The depressions 32 constitute 8.7% of the total area of hemispherical surface 12.

Figure 7:
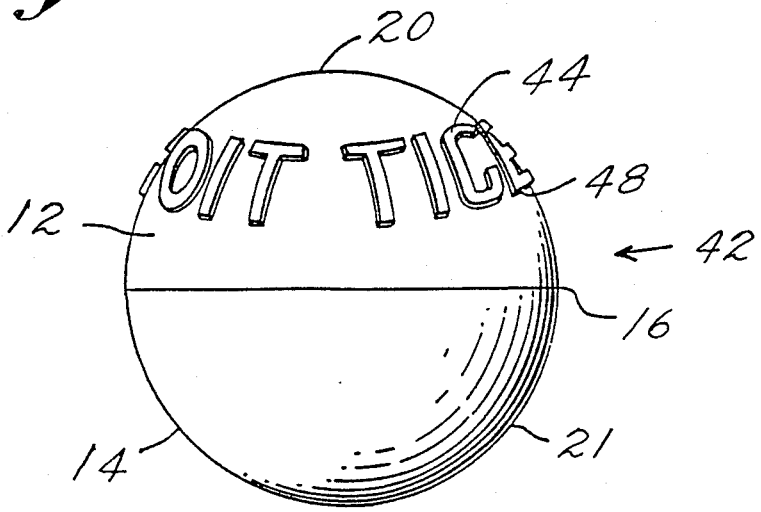
FIG. 7 is a side elevation of a further ball in accordance with this invention.
Figure 8:
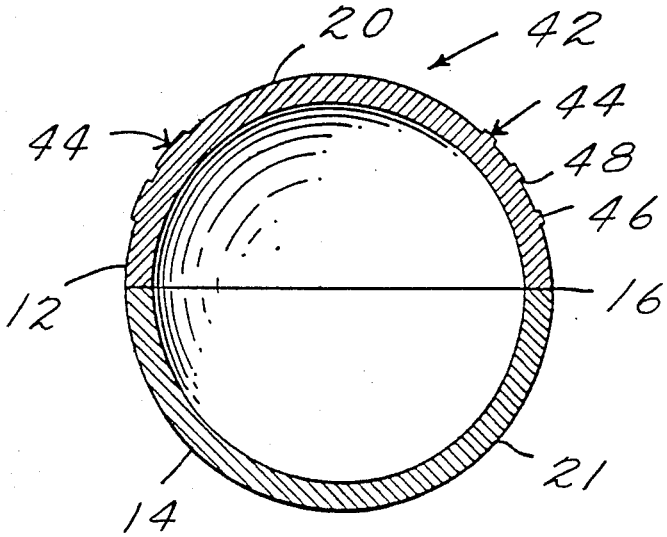
FIG. 8 is a cross-section through the ball of FIG. 7.

The ball 42 of FIGS. 7 and 8 is similar to those of FIGS. 1 and 2, and 3 and 4, and reference numerals 12 to 16, 20 and 21 have the same meanings.

Hemisphere 12 of ball 42 is provided with raised portions or protrusions 44, shown as letters, although they could be of any shape or pattern. The raised portions 44 constitute, in this embodiment 'disturbed areas' or 'surface disturbances' of surface 20. The raised portions 44 have surfaces 46 and edges 48. Although the edges 48 are shown as sharp, the protrusions may have a curved or semicircular cross-section, rather as the complements of depressions 28 on the right-hand side of FIG. 4. The raised portions 44 constitute 8.0% of the total surface area of hemisphere 12. One may view ball 42 and its protrusions 44 as the opposite case to ball 26 and its depressions 28.

In the embodiment of FIGS. 7 and 8, the protrusions 44 occupy the middle one-third annulus of the surface 20 of the first hemisphere 12, between the boundary 16 and the apex of the hemisphere 12.

If any of the balls of FIGS. 1 to 8 are propelled along the plane of boundary line 16, the ball will deviate from that plane in the direction of hemisphere 12. That is, if the ball is projected with hemisphere 12 on the left of the plane, the ball will deviate in flight to the left of the plane.

The ball is projected with some back spin, about an axis perpendicular to the plane, which back spin cannot in practice be avoided in attempting to project a ball without spin. No other spin is required or desired to be imparted to the ball.

As has been discussed earlier in this specification, the theory behind the behaviour of the curving or swinging motion of conventional balls is not well understood. It is believed that the behaviour of the various balls embodying the present invention may be explained in simple terms as follows.

As the ball of this invention rotates in flight, the partially disturbed surface characteristics of first hemisphere 12 trigger a form of air turbulence not experienced around smooth second hemisphere 14. Once turbulent, the air escapes more readily over the greater remaining smooth portions of first hemisphere 12, causing a pressure drop or 'vacuum effect' on the hemisphere. The ball thereby deviates laterally towards this 'vacuum' due to the greater remaining pressure on second hemisphere 14. As this action continues, the ball describes a curved path away from a plane in which the boundary line 16 connecting the two hemispheres lies.

When the surface of second hemisphere 14 is provided with a homogeneous surface texture (such as shown in the embodiment of FIGS. 5 and 6, or with golf ball dimples or the like) the curve or deviation is seen to be enhanced due to additional pressure build up on this hemisphere created by the drag effect of the homogeneously rough surface of hemisphere 14.

Figure 9:
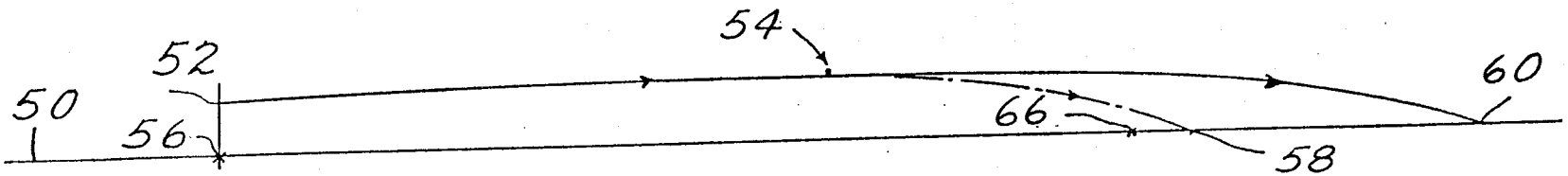
FIG. 9 is a diagram showing the performance of a ball of the type shown in FIGS. 5 and 6 when thrown as a 'shooter'.
Figure 10:
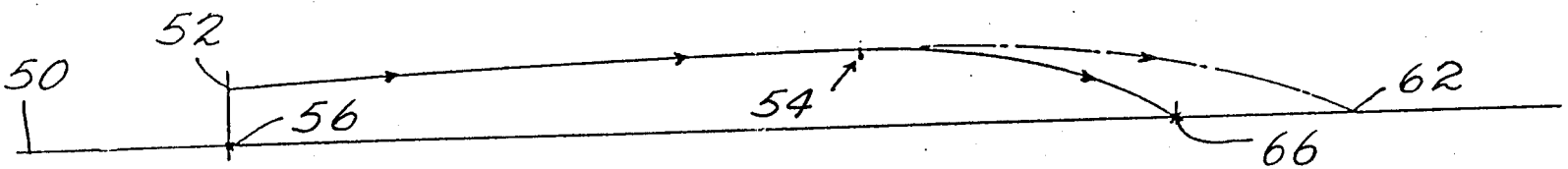
FIG. 10 is a diagram showing the performance of a ball of the type shown in FIGS. 5 and 6 when thrown as a 'dropper'.
Figure 11:
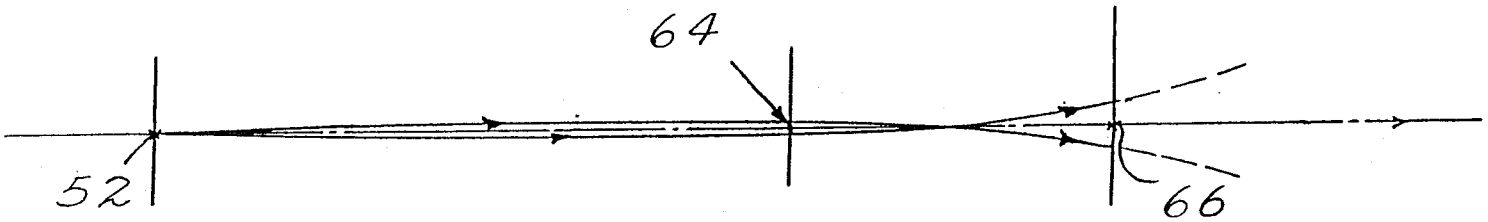
FIG. 11 is a diagram showing the performance of a ball of the type shown in FIGS. 5 and 6 when thrown to curve left or right.

FIGS. 9 to 11 show diagrams of tests made with a ball of the same general type as that of ball 30 of FIGS. 5 and 6.

FIG. 9 is a side elevation of a testing area. Ground level is indicated by 50, the projection point by 52, and a horizontal bar is shown at 54. Projection point 52 was 3'6" above point 56 representing a pitchers' plate, and bar 54 was 4'6" above ground level 50. The trajectory of a ball thrown not to curve is shown by a broken line, and that of a ball thrown to curve is shown by a solid line. Point 66 represents a batter's plate.

It can be seen that the 'normal' ball lands at point 58, 4' past plate 66 When the ball is thrown as a 'shooter', that is, to deviate upwards from the intended trajectory, the ball landed at point 60, 23' from the plate 66, 19' beyond the 'normal' pitch. In each case, as shown, the ball was thrown as near as possible to the underside of bar 54.

FIG. 10 is similar to FIG. 9 and the same reference numerals and dimensions apply. In each case, the ball was projected to pass as near as possible to the top of bar 54. In the case of the 'swing' ball of this invention, it was projected as a 'dropper', that is to deviate downwards from the expected trajectory.

The normal ball landed at point 62 11' past plate 66. However, the ball of this invention landed on plate 66, 11' shorter than the 'normal' pitch.

FIG. 11 is a plan view, with a vertical bar 64, but otherwise the dimensions and conditions were the same as for FIGS. 9 and 10. A 'normal' pitch travelled in a straight line. A pitch to deviate left passed 1'6" to the left of plate 66, and a pitch to deviate right passed the same distance to the right of plate 66.

It has already been indicated that the effectiveness of the balls is enhanced if the hemisphere 14 is not totally smooth, but has a rough texture, preferably of an homogeneous nature. It has also been found that on first hemisphere 12, depressions are more effective if they are located in the middle one-third of the surface 20 rather than near the crown or line 16. However, with a recurring pattern (as in ball 10 of FIGS. 1 and 2) it is preferred to locate the depressions over the entire surface of the hemisphere for visual reasons.

The depressions or protrusions may be produced by moulding them into or onto a surface, by machining a surface, or by adhering materials thereto. The balls may be hollow or solid, or formed from a foam material, and although a ball of the weight of a tennis ball or hollow rubber ball is preferred, other weights could be used. A simulated seam could be included; as long as it coincided with line 16, it would not adversely effect the performance of the ball.

It is preferred to mould the ball with the first hemisphere in the one operation although existing balls, rubber balls, tennis balls or the like, could be modified.

The various embodiments of this invention provide a ball which can be played with as a normal ball, either to deviate or not to deviate, and can also be used in practice, particularly to enable a hitter or batsmen to practice against curving pitches or deliveries.

I claim:

1. A hand projectable game ball of generally spherical shape including a pair of complementary hemispherical portions joined along a generally equatorial line, one of said hemispheres of said pair including a predetermined uniform surface configuration extending over the entire surface of said hemisphere, the other hemisphere of said pair including an equatorial zone immediately adjacent said equatorial line, a polar zone and an intermediate zone between said polar and said equatorial zones, and flight control means on said other hemisphere substantially influencing the flight of the ball when thrown and confined solely to the area of said other hemisphere delineated as said intermediate zone and occupying between 1 and 30 percent of said second hemispherical surface.

2. A ball according to claim 1 wherein said flight control means comprises surface disturbance within said intermediate zone significantly interrupting the surface of the ball, the remainder of the spherical surface of the ball being devoid of surface disturbance.

3. A ball according to claim 2, wherein said surface disturbance comprises at least one depression in said other generally hemispherical surface.

4. A ball according to claim 3, wherein said at least one depression comprises a regular pattern of depressions in said other generally hemispherical surface.

5. A ball according to claim 4, wherein each said depression has the shape of informational indicia including letters or numbers.

6. A ball according to claim 2, wherein said surface disturbance comprises at least one protrusion on said other generally hemispherical area.

7. A ball according to claim 6, wherein said at least one protrusion comprises a regular pattern of protrusions on said one generally hemispherical surface.

8. A ball according to claim 7, wherein each said protrusion has the shape of informational indicia including letters or numbers.

9. A ball according to claim 2, wherein said other generally hemispherical surface is provided with a uniform texture.

* * * * *